US005894642A

United States Patent [19]

Eberhardt

[11] Patent Number: 5,894,642

[45] Date of Patent: Apr. 20, 1999

[54] HOOK AND LOOP HANGER FOR SHOWER CURTAIN AND LINER

[76] Inventor: Stephanie A. Eberhardt, 183 Roundabout Trail, Camden, Del. 19934

[21] Appl. No.: 09/041,389

[22] Filed: Mar. 12, 1998

[51] Int. Cl.[6] ..... A47H 1/00

[52] U.S. Cl. ..... 24/716; 160/368.1; 160/330

[58] Field of Search ..... 24/716, 306, 442; 160/330, 368.1, DIG. 6; 4/558, 608; 16/87.2, 87.4

[56] References Cited

U.S. PATENT DOCUMENTS

| | | | |
|---|---|---|---|
| 3,196,511 | 7/1965 | Kintner . | |
| 4,972,896 | 11/1990 | Roberts | 160/368.1 X |
| 4,991,640 | 2/1991 | Verkndt et al. | 160/368.1 |
| 5,109,912 | 5/1992 | Gary . | |
| 5,111,868 | 5/1992 | Sawaya | 160/330 |
| 5,148,580 | 9/1992 | Dyckow . | |
| 5,170,974 | 12/1992 | Ruggiero | 160/330 X |
| 5,186,232 | 2/1993 | Zahner | 160/330 |
| 5,228,149 | 7/1993 | Phinn, Jr. . | |
| 5,421,393 | 6/1995 | Wolfe . | |
| 5,495,628 | 3/1996 | Logan . | |
| 5,544,387 | 8/1996 | Yamamoto et al. | 24/716 X |
| 5,586,595 | 12/1996 | Takizawa et al. . | |
| 5,615,461 | 4/1997 | Tominaga et al. . | |
| 5,651,407 | 7/1997 | Perez . | |

FOREIGN PATENT DOCUMENTS

| | | |
|---|---|---|
| 1162201 | 8/1969 | United Kingdom . |

*Primary Examiner*—Anthony Knight
*Assistant Examiner*—Robert J. Sandy
*Attorney, Agent, or Firm*—Richard C. Litman

[57] ABSTRACT

A flexible elongated combination shower curtain and liner hanger device with reinforced apertures in an upper region for hanging the hanger element from a shower rod by hooks. The lower region of the hanger device has loop strips on both sides for fastening of the shower curtain and the shower liner to a horizontal rod by hook strips on their upper edges. The hanger device can be clear or colored to match the color of the shower curtain and shower liner.

6 Claims, 1 Drawing Sheet

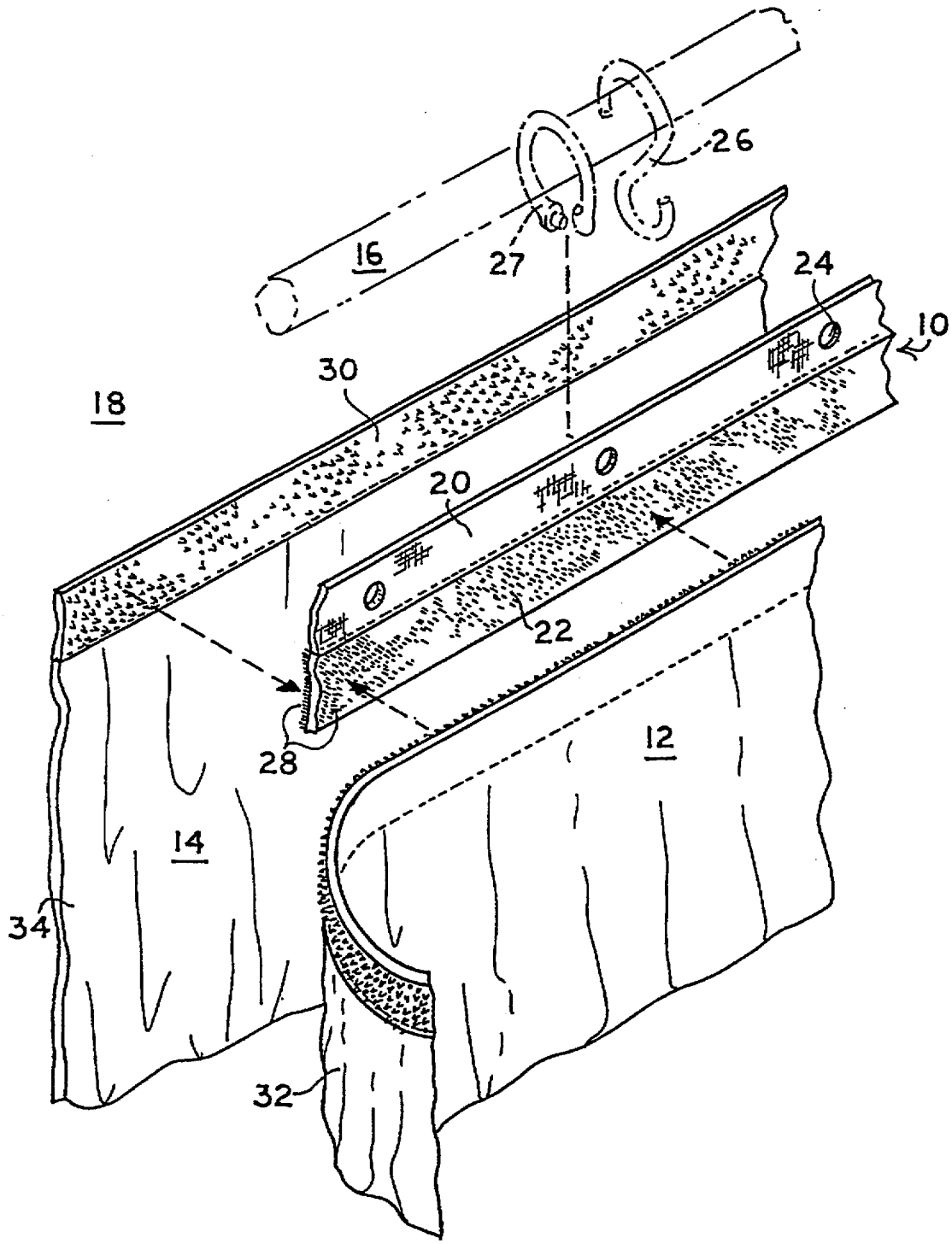
26
16
27
24
10
30
18
20
22
28
12
14
34
32

HOOK AND LOOP HANGER FOR SHOWER CURTAIN AND LINER

BACKGROUND OF THE INVENTION

1. Field of the Invention

The present invention relates to a combination of a shower curtain and a liner with upper hook strips fastened to a horizontal rod by a hanger device with loop strips on both sides. The hanger element has apertures for hooks for suspending the hanger device from the rod.

2. Description of the Related Art

There is a need for the elimination of the source of aggravation to a homeowner who must deal with torn apertures in shower curtains and shower liners which are suspended by hooks or rings from a horizontal rod in a bathroom shower stall. There is a need for a device which would enable persons with arthritic hands and arms to easily change or clean a shower curtain and liner. The user need not struggle or waste time to hang the hooks to change shower curtains and liners repeatedly. The present invention allows for easy cleaning of shower curtains and liners by the simplified removal. Also, the present invention provides for inexpensive liners which can be made disposable. The solution comprises a separate hanger device upon which the shower curtains and liners without apertures but with strips of cooperating hook material can attach to the loop material (e.g., VELCRO™) strips of the hanger device of the present invention.

The related art of interest describes various holders for various curtains with hook and loop fasteners. The related art will be discussed in the order of perceived relevance to the present invention.

U.K. Patent Application No. 1,162,201 published on Aug. 20, 1969, for Joseph R. Wylde describes hook and loop means for attaching a curtain to a rail. An I-beam serves as a holder for a plastic U-shaped runner which may have rollers. One-inch square. woven fabric pieces with selvedges at its ends have an aperture at one end for hanging from a runner and a hook material on one side for attachment to the loop material configured as one or more strips or a plurality of squares secured to a curtain along with or on pleating strips. The modified curtains and rail may be used for hospitals where decoration of the curtain is unimportant. The hanging system of the publication is distinguished by its requirement for a rail and only one curtain.

U.S. Pat. No. 5,109,912 issued on May 5, 1992, to Leonard Gary describes a drapery system employing a standard C-shaped drapery rack housing which holds a drapery carrier having a spool-shaped head portion supporting a flat plate portion having hook material on one side and loop material on the other side. These fastening aids will attach to hook or loop patches on the top rear edge of the drapery. The drapery may have pockets for inserting the drapery carriers. The drapery system is distinguishable for its reliance on separate drapery carriers of a specific configuration.

U.S. Pat. No. 5,495,628 issued on Mar. 5, 1996, to Kim Logan describes a shower curtain having a selectively raisable lower portion by utilizing several horizontal rows of hook or loop patches on a shower curtain and a shower curtain liner. The curtains are suspended from a horizontal rod by ring fasteners. The shower curtains are distinguishable for placing the hook and loop patches at different locations for a different purpose.

U.S. Pat. No. 5,615,461 issued on Apr. 1, 1997, to Yutaka Tominaga et al. describes a hanging device for a pleated curtain having separated patches of female or looped fasteners on its top rear edge which mate with a plurality of curtain hanging fasteners. A fastener comprises a rectangular plate-like base member with a top hook. The base member has a critical arrangement on one face of male or hook fasteners which are molded with the plastic base. The hooks are formed in three groups with the hooks directed either downward or outward to resist disengagement. The hanging device is hooked onto a curtain runner with rollers traversing a C-section curtain rail. The hanging device is distinguishable based on its critical arrangement of hooks on the base member and the requirement for looped material pieces on the curtain.

U.S. Pat. No. 5,586,595 issued on Dec. 24, 1996, to Toshiaki Takizawa et al. describes a curtain attachment connector comprising a fastener member similar to that of Tominaga et al. except for the arrangement of the hook elements arranged in rows, columns or in a scattered array with the hook ends up. This curtain attachment connector is distinguishable for its requirement of only hooks on the fastener member.

U.S. Pat. No. 5,228,149 issued on Jul. 20, 1993, to Alex J. Phinn, Jr. describes a fastening means and method for a shower curtain employing hook and loop material for fastening only the side edge of the curtain to the wall of the shower stall. A disposable rule is supplied for positioning of the patches of fastening material to the wall which are spaced closer than the patches on the shower curtain to obtain a tensioning effect. The fastening system is distinguished by its use for attaching a side of a shower curtain to a shower stall wall, and the absence of a suggestion for attaching shower liners as well.

U.S. Pat. No. 5,148,580 issued on Sep. 22, 1992, to Dean W. Dyckow describes a shower curtain sealing and fastening arrangement kit. A strip of hook or loop material is attached to one side edge of a shower curtain to mate with another strip of loop or hook material on the shower stall wall. A sealing protrusion strip is also provided to apparently clamp the edge of the shower curtain. This arrangement is distinguishable for attaching only a side of the shower curtain to the wall, and the absence of a suggestion for attaching shower liners.

U.S. Pat. No. 5,651,407 issued on Jul. 29, 1997, to Hilda M. Perez describes looped shower curtain fasteners utilizing hook and loop fastening dots to attach to the top edge of a shower curtain. The loops are strengthened with a plastic strip and can be decorative with eyelet fasteners for artificial flowers. The fasteners are distinguished by the critical use of loops.

U.S. Pat. No. 3,196,511 issued on Jul. 27, 1965, to Mildred M. Kintner describes fastening draperies and curtains with U-shaped band-like members having upper apertures for traversing rod and felt pads at its ends for grasping the pleats of the drapery or curtain. Hook and loop material patches are utilized for fastening clothes, which use is distinguishable from the present invention.

U.S. Pat. No. 5,421,393 issued on Jun. 6, 1995, to Michael Wolfe describes a shower curtain edge stay by utilizing stiffened horizontal rib members disposed in the shower curtain adjacent to a lower vertical side edge and hook and loop tabs on the lower side edge to attach to a wall. Curtain magnets on the lower edge of the shower curtain are also employed to prevent inward curling. The curtain edge stay is distinguishable by its use of hook and loop material only on a lower edge of the shower curtain.

None of the above inventions and patents, taken either singularly or in combination, is seen to describe the instant invention as claimed. Thus, a hook and loop hanger for a shower curtain and a liner solving the aforementioned problems is desired.

SUMMARY OF THE INVENTION

The present invention relates to a combination of a shower curtain and a liner with hook strips on their upper edges being suspended from a horizontal rod by a flexible hanger device having cooperating loop strips on both sides in its lower region. The hanger device has a series of apertures in its upper region for hooks for hanging from the rod.

Accordingly, it is a principal object of the invention to provide a flexible hanger device for suspending a shower curtain and a liner in a shower facility.

It is another object of the invention to provide a hanger device for suspending a shower curtain and a liner with hook and loop elements.

It is a further object of the invention to provide a hanger device having a series of reinforced apertures in its upper region for attachment to suspension hooks.

Still another object of the invention is to provide a hanger device having loop elements on both sides in a lower region for cooperation with hook elements on the upper edges of the shower curtain and liner.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

The sole FIGURE is an exploded environmental, perspective view of the invention utilized to support a shower curtain and a shower liner on a curtain rod in a shower facility.

Similar reference characters denote corresponding features consistently throughout the attached drawings.

DETAILED DESCRIPTION OF THE PREFERRED EMBODIMENTS

The present invention shown in the FIGURE is a hanger device 10 for suspending both a shower curtain 12 and a shower liner 14 from a horizontal rod 16 (shown in shadow). The device 10 comprises a flexible rectangular sheet commensurate in length with the horizontally disposed rod 16 in a shower stall or facility 18. The sheet or hanger device 10 has an upper region 20 and a lower region 22. A series of apertures 24 reinforced with grommets 23 are equidistantly spaced apart in the upper region to accommodate the S-hooks 26 or rings 27 (shown in shadow).

The hanger device 10 has an elongated strip of loop material 28 on each side in the lower region 22. The requirement for loop material 28 is critical, because when the shower curtain 12 and liner 14 are detached for cleaning, the exposed loop material 28 does not scratch anyone touching it. The shower curtain 12 has a strip of hook material 30 commensurate in size with the loop material strips 28 on an upper edge of its rear surface 32. Similarly, the shower liner 14 has a strip of loop material at its upper edge of its front surface 34. Thus, the shower curtain 12 and the shower liner 14 can be secured to the hanger device 10 by cooperative fastening of the loop material strips 28 of the hanger device 10 to the hook material strips 30 of the shower curtain 1.2 and the shower liner 14.

The hanger device 10 can be made of a clear material such as a transparent, a translucent or a pellucid material. The hanger device 10 can be colored such as in white or colored to match the color of the shower curtain and shower liner. It is also within the ambit of the present invention to incorporate matching or color coordinated ornamental designs for the hanger device 10, shower curtain 12 and the shower liner 14 as a set for the homeowner.

The hanger device 10 can be made of a flexible material such as a cloth fabric, a plastic and a plastic coated cloth fabric. It should be understood that the hanger device 10 can have a length greater than, equal to or smaller than the length of the shower curtain 12 and the shower liner 14.

Thus, a combination hanger device can be utilized for suspending a shower curtain and a shower liner from a horizontal rod in a bathroom shower stall that does not require apertures and rings or hooks in the shower curtain and liner for attaching them to the rod. The life of an expensive set of a shower curtain and liner is thus prolonged by eliminating the torn apertures which is an irritating problem with the conventional apertured shower curtains and liners.

Another advantage is the uncomplicated removal of the shower curtain or liner for cleaning. Persons afflicted with arthritic hands can now more readily without pain remove and attach the shower curtain and liner. Finally, if the liner which takes the brunt of abuse in a shower stall must be replaced, the soiled or torn liner can be readily replaced as provided in the present invention.

It is to be understood that the present invention is not limited to the embodiments described above, but encompasses any and all embodiments within the scope of the following claims.

I claim:

1. A combination of a hanger device having a shower curtain, a shower liner, and a horizontally disposed rod, said combination comprising:

a flexible rectangular sheet generally commensurate in length with a horizontally disposed rod in a shower facility;

said sheet having an upper region and a lower region;

a series of spaced-apart apertures in said upper region of said sheet;

an elongated strip of loop material on each side of said sheet in said lower region;

a shower curtain having a strip of hook material at its upper edge of its rear surface; and a shower liner having a strip of hook material at its upper edge of its front surface;

whereby said hanger device is attached to said horizontally disposed rod by hooks passing through said apertures of said hanger device, and said shower curtain and said shower liner being attached to said hanger device by cooperative fastening of said loop material strips of said hanger device to said hook material strips of said shower curtain and said shower liner.

2. The combination according to claim 1, wherein said series of apertures include reinforcing means.

3. The combination according to claim 1, wherein said hanger device is made of a clear material selected from the group consisting of transparent, translucent and pellucid.

4. The combination according to claim 1, wherein said hanger device is made of a flexible material selected from the group consisting of a cloth fabric, plastic and plastic coated cloth fabric.

5. The combination according to claim 1, wherein said hanger device has a color selected from the group consisting of white and colored to match the color of the shower curtain and shower liner.

6. The combination according to claim 1, wherein said hanger device has a horizontal length greater than, equal to or smaller than the horizontal length of said shower curtain and said shower liner.

* * * * *